US008141458B1

(12) United States Patent
Spencer et al.

(10) Patent No.: US 8,141,458 B1
(45) Date of Patent: Mar. 27, 2012

(54) HAMMER HEAD WITH RECESSED TRACTION STRIKING SURFACE

(76) Inventors: Stephen M. Spencer, Bolingbrook, IL (US); Richard A. Spencer, Shawnee, KS (US)

( * ) Notice: Subject to any disclaimer, the term of this patent is extended or adjusted under 35 U.S.C. 154(b) by 362 days.

(21) Appl. No.: 12/614,830

(22) Filed: Nov. 9, 2009

Related U.S. Application Data

(60) Provisional application No. 61/199,125, filed on Nov. 13, 2008.

(51) Int. Cl.
*B25D 1/00* (2006.01)

(52) U.S. Cl. ..... 81/20

(58) Field of Classification Search ..... 81/20, 21; 76/103; 473/330; D8/75, 78
See application file for complete search history.

(56) References Cited

U.S. PATENT DOCUMENTS

| | | | | | |
|---|---|---|---|---|---|
| 121,682 | A * | 12/1871 | Stocum | 81/21 |
| 1,262,515 | A * | 4/1918 | Kingsley | 81/20 |
| 1,718,161 | A * | 6/1929 | Lutch | 81/21 |
| 2,765,827 | A * | 10/1956 | Hall | 81/21 |
| 3,000,414 | A * | 9/1961 | Cordis | 81/22 |
| 3,067,790 | A * | 12/1962 | Tucker | 81/21 |
| 3,640,324 | A * | 2/1972 | Porter | 81/20 |
| 4,200,130 | A * | 4/1980 | Reamy | 81/20 |
| 4,240,478 | A * | 12/1980 | Wilson | 81/20 |
| D408,702 | S * | 4/1999 | Hammond et al. | D8/75 |
| D415,003 | S * | 10/1999 | Freeman | D8/78 |
| 6,176,156 | B1 | 1/2001 | Coonrad | |
| 6,435,059 | B1 | 8/2002 | Martinez | |
| 6,536,308 | B1 * | 3/2003 | Thorne et al. | 81/20 |
| 7,350,440 | B2 * | 4/2008 | Casolco | 81/20 |
| 2003/0037641 | A1 * | 2/2003 | Coonrad | 81/20 |
| 2004/0159189 | A1 * | 8/2004 | Luton | 81/20 |

* cited by examiner

*Primary Examiner* — David B Thomas
(74) *Attorney, Agent, or Firm* — Erickson, Kernell, Derusseau & Kleypas, LLC

(57) ABSTRACT

A hammer head includes a centrally located traction surface surrounded by a peripheral striking face. The portion of the hammer head forming the traction surface is comprised of a harder material than the surrounding portion of the hammer head, such that wear to the traction surface is inhibited. The centrally located region may be formed as a separate disk with a knurled outer surface that is press fit into a cavity formed in the hammer head main body. The traction surface is preferably recessed relative to the surrounding portion of the hammer head but may also extend flush therewith.

18 Claims, 2 Drawing Sheets

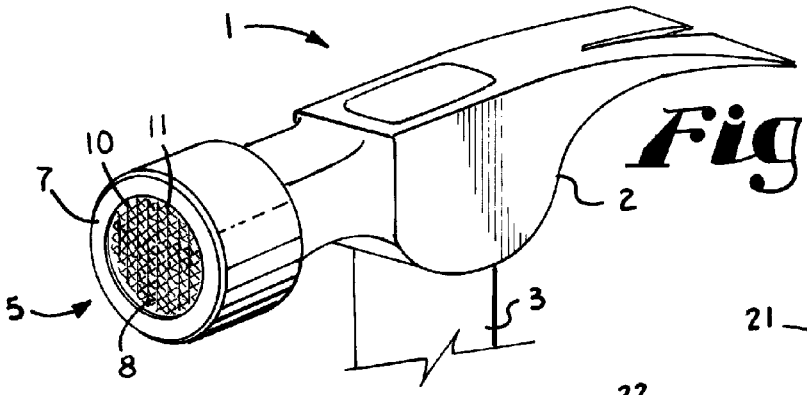
Fig.1.
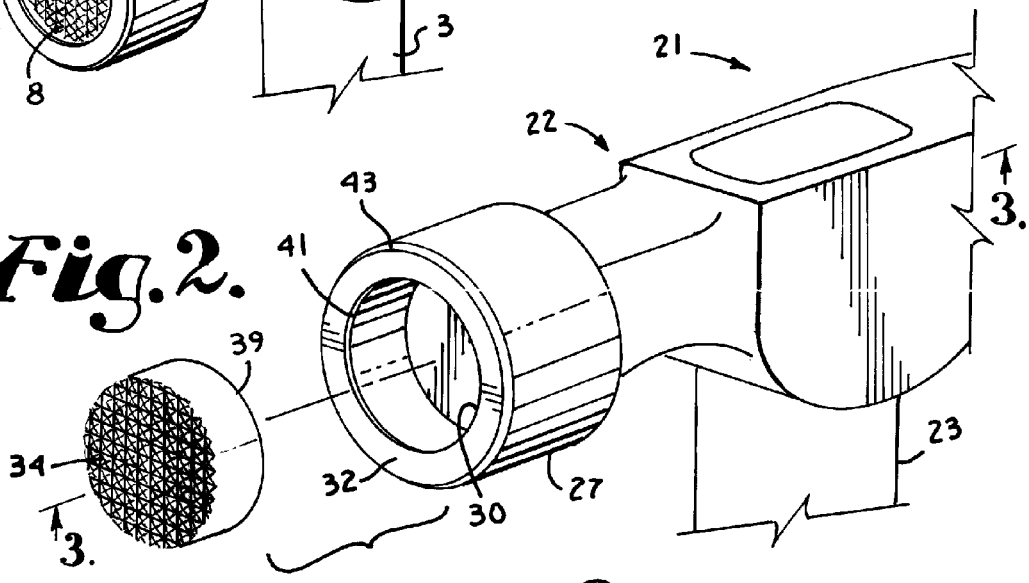
Fig.2.
Fig.3.
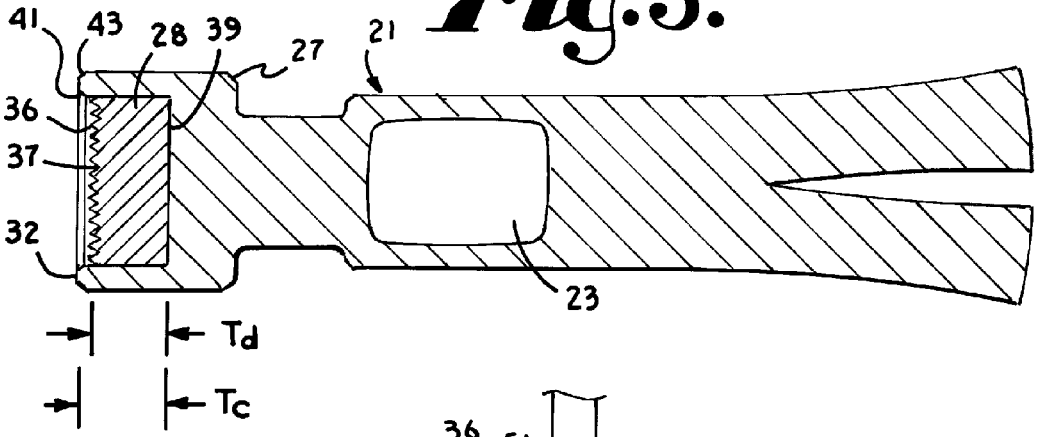
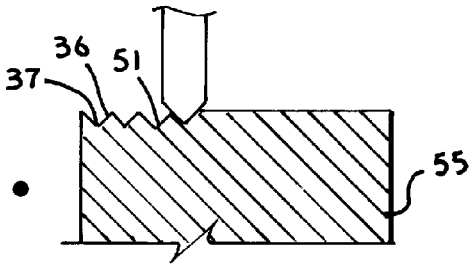
Fig.5.

HAMMER HEAD WITH RECESSED TRACTION STRIKING SURFACE

CROSS-REFERENCE TO RELATED APPLICATIONS

This application claims the benefit of the prior filed, co-pending provisional application Ser. No. 61/199,125, filed Nov. 13, 2008, which is hereby incorporated by reference herein.

BACKGROUND OF THE INVENTION

The present invention relates to hand tools, and more particularly, to a traction striking surface feature provided on the head of a framing hammer, accommodating a demand for a more resilient and wear resistant traction surface, as well as addressing the need for two different hammers for rough framing and finish trim work, thereby improving the versatility of claw hammers.

Hand held striking tools, such as claw hammers, have been used for centuries by people performing a great variety of tasks associated with carpentry. Typically, steel and titanium framing and finish hammers are used to deliver a striking force to drive nails into wood and other materials. The claw of a hammer is used, for example, to pull nails from said materials, or to pry materials apart that have been nailed together.

Concerning the traction surface of a striking face of a hammer and the commonly used materials for making hammer heads, there is a correlation between the weight, durability, and the practical application of different materials used in making hammer heads. Framing and trim hammers alike are typically made of steel or titanium, and the mass of the head, when swung by a person, creates a force to drive a nail into a given material, most commonly wood.

Framing hammers, in particular, have a specially formed traction surface formed into the striking face of the hammer, for providing a better "grip" on the nail being struck, and preventing the face of the hammer from glancing or sliding off the head of the nail as readily. This "waffle type" textured pattern or knurled surface used for traction greatly increases the nail driving efficiency of a framing hammer. Framing hammers are so named, particularly, because they are used mostly in rough framing applications of carpentry, where surface damage caused to the wood by the traction surface is of no consequence to the finished product being framed.

There are, however, many applications in rough carpentry where work is done with finished surface materials, and a smooth faced hammer is needed to prevent formation of damaging, waffle print indentations in the product being built.

In addition, a further drawback heretofore is that the waffle traction surface of a framing hammer typically wears smooth quickly with regular use, reducing nail driving efficiency and causing the risk of flying projectiles as pieces of the traction surface tend to break off as the hammer is striking nails. This is especially problematic with titanium hammer heads, but nonetheless prevalent with all framing hammers.

What is desirable is a hammer structure according to which the traction surface is prevented from contacting the material being worked on, aside from the nail being driven, and which is advantageously equipped with a more durable traction surface for the textured striking face of framing hammers.

Advantageously, these improvements would be provided without the manufacturing cost associated with heat treating an entire hammer head to attain hardening of the striking surface, which would concomitantly increase the chance of breaking the claw portion of the hammer head when prying force is applied, as in pulling nails or ripping materials apart.

An object of the invention is to provide a hammer that can be used for both rough framing and finish carpentry work while providing a traction surface for striking nails without damaging finished surface materials.

Another advantageous object of the invention is to provide a hammer with a more durable traction striking surface having a much greater resistance to wear.

SUMMARY OF THE INVENTION

The above described objects are achieved by a hammer structure in which a striking face of a hammer head includes a centrally disposed, textured traction striking surface. The traction striking surface is preferably recessed from a remainder of the striking face surrounding the centrally disposed traction striking surface. The portion of the striking face surrounding the central traction striking surface has a relatively smooth surface, such that when the hammer is used, the nail is driven into the work piece (e.g., a wooden structural component) by striking contact of a nail, or other driven fastener, by the traction surface, while at the same time, damage is minimized by the recessed nature of the central textured region and the raised relatively smooth surfaced border which is the only part actually coming in contact with the surface being worked on.

The above described feature can be implemented by employing suitable fabricating, molding or other production techniques to obtain the desired recessed textured traction surface in a form of a hammer head having unitary structure of uniform material. Alternatively, the completed hammer head can be comprised of at least two assembled parts comprising a main hammer head body having a cavity formed in a striking face thereof and an insert, in the form of a disk or other suitably shaped insert, which is received in fixed engagement within the cavity, for example, by press fit engagement. The disk could be comprised of a material having characteristics generally matching those of the main hammer head body, or of a different material with different characteristics.

In one embodiment, a wear resistant traction surface is achieved through the use of a hardened steel disk with a traction surface formed into the face of the disk which is fitted into a receiving cavity formed in a striking face of the above mentioned main hammer head body with the textured traction surface positioned in an outward facing orientation. The disk advantageously has a hardness of about Rockwell 55 or greater.

In a particularly preferred embodiment, the disk is inserted in place of the striking surface in a cavity in the face of the hammer. The disk is advantageously recessed within the cavity about 1/16 of an inch deeper than a plane of the non-textured striking surface.

Advantageously, the disk is fitted in a hammer head made of titanium or titanium alloy, replacing the titanium striking surface. This embodiment provides the light weight advantages of titanium hammer heads, while providing a much longer usable life of the traction striking surface.

In a further preferred embodiment, the disk is inserted in a hammer head made of steel, where the need for a heavier hammer head is addressed, while still providing a much more wear resistant traction surface than a conventional hammer's striking surface.

As mentioned above, in accordance with a preferred embodiment, the disk is placed in the face of a hammer head in a way that it is recessed from the plane of the striking surface about 1/16 of an inch, leaving the forward-most plane of the striking surface as a smooth rim (for example, an annulus) about 1/4 of an inch wide around the outside perimeter of the face of the hammer head. This embodiment allows only the smooth portion of the striking surface to contact the material that the nail is being driven into, eliminating the damaging waffle pattern indentations caused by misdirected or glancing blows, or the final blow that sets the head of the nail flush or beyond the surface of the material the nail is being driven into. This embodiment also eliminates the need for a second, smooth faced hammer for use with finished materials. This embodiment is also advantageous in concrete work, where a hammer is used consecutively to drive both nails and pins used to hold forms together.

In the case of driving wedge pins in form work, a traction surface on the striking face is worn down quickly, while excessively damaging the reusable pins. The application of the recessed traction surface allows the use of the same hammer in driving wedge pins and nails for fastening wood members, while reducing wear on both the hammer head and reusable pins considerably.

A preferred embodiment of the invention, illustrative of the best mode in which the applicant has contemplated applying the principle, is set forth in the following description with reference to the drawings.

BRIEF DESCRIPTION OF THE DRAWINGS

FIG. 1 is a side perspective view of a hammer in accordance with an embodiment of the invention (handle only partially depicted);

FIG. 2 is a fragmentary, exploded, side perspective view showing a hammer in accordance with another embodiment of the invention;

FIG. 3 is a cross-sectional view taken generally along line 3-3 of FIG. 2.

FIG. 5 is a fragmentary, schematic view showing a machine tool forming grooves in a metal rod to form the knurled insert.

DETAILED DESCRIPTION OF THE PREFERRED EMBODIMENT

Figure 6:
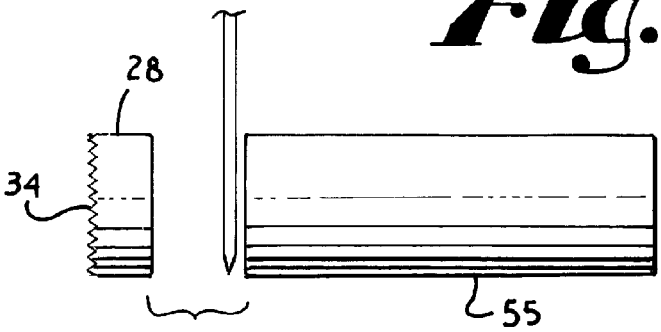
FIG. 6 is a schematic view showing a machine tool cutting off a portion of the metal rod of FIG. 5 in which grooves have been formed to form the knurled insert.

A hammer structure is disclosed which includes a traction surface provided on a centrally located region of a striking face of the head of the hammer wherein the portion of the striking face surrounding the traction surface is relatively smooth. The centrally located region is preferably comprised of a harder material than a remainder of the hammer head, including the region surrounding the traction surface. The traction surface is preferably recessed relative to the surrounding hammer face, such that wear to this working surface is inhibited.

A first embodiment of the invention is depicted in FIG. 1, in which a hammer 1 includes a hammer head or hammer head body 2 carried on a handle 3. A forward portion of the hammer head 2 includes a striking face 5 generally arranged in a striking plane extending perpendicular to a striking (swing) direction of the hammer 1 during use. The striking face 5 of the hammer head 2 includes a peripheral region or surface 7 and a central, recessed region or surface 8, surrounded by the peripheral region 7. The recessed surface 8 is knurled or textured with a waffle type texture and is recessed relative to the remaining surrounding peripheral region 7 of the striking face 5. The recessed surface 8 may also be referred to as the traction surface or traction surface region 8. The peripheral region 7 of the striking face 5 has a substantially non-textured or smooth surface oriented generally parallel to the traction surface region 8.

In use, the framer or carpenter aims the hammer 1 to strike the head of a nail with the traction surface 8 until the nail is driven into the substrate as far as it can by striking with the traction surface 8. The carpenter can then strike or tap the nail with the peripheral or smooth region 7 of the striking face 5 to finish driving the nail into the substrate.

The knurling on the textured, recessed surface 8 includes peaks 10 and valleys 11. The peaks 10 of the recessed surface 8 are recessed relative to the surrounding, peripheral surface preferably by one sixteenth of an inch or less. It is foreseen that the peaks 10 may be recessed further, including approximately one eighth of an inch or less, but the greater the depth that the textured region 8 is recessed relative to the smooth, peripheral portion, the higher the head of a nail will extend when driven into the substrate using only the textured region 8 of the hammer head 2.

The hammer head body 2 may be formed by casting. The textured surface region 8 may be spot hardened to increase the hardness of the textured region 8 relative to the rest of the hammer head body 2. Hardening of the textured surface region 8 will reduce wear of the textured surface region 8.

Figure 4:
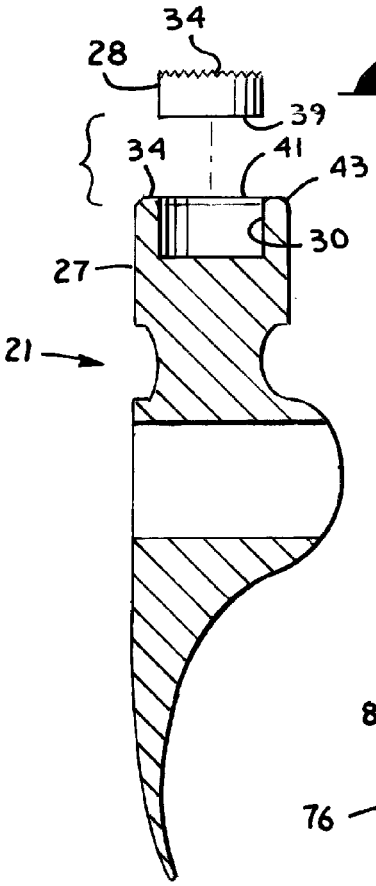
FIG. 4 is an exploded side view of the hammer as in FIG. 2 showing a knurled insert separated from the hammer head which is shown in cross-section to show the cavity for receiving the knurled insert.
Figure 7:
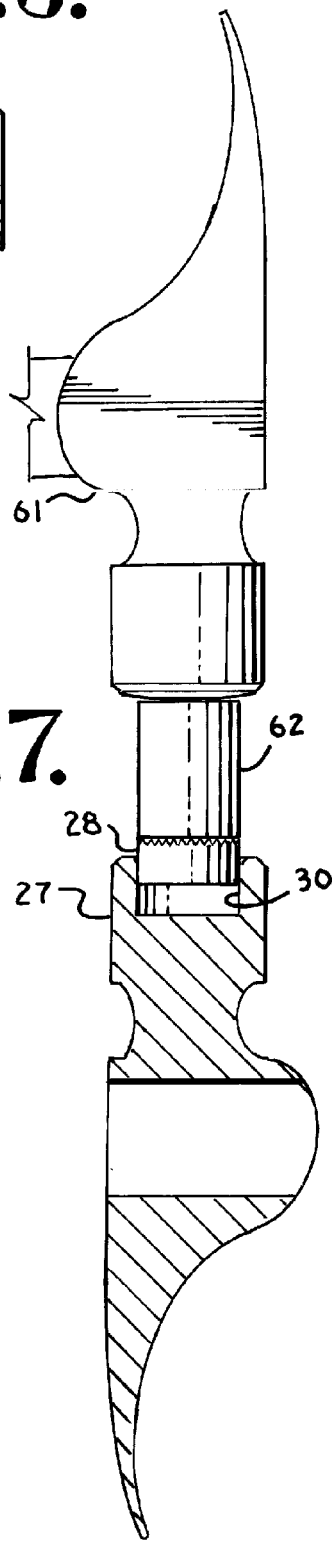
FIG. 7 is a fragmentary side view showing insertion of the knurled insert into a hammer head main body which is shown in cross-section to show the cavity for receiving the insert.

An alternative embodiment of a hammer 21 incorporating a recessed, textured, striking surface is shown in FIGS. 2-4. The hammer 21 includes a hammer head 22 mounted on a handle 23. The hammer head 22 includes a hammer head main body 27 and a knurled insert or disk 28 secured in a cavity 30 formed in a front facing, smooth, striking face 32 of the hammer head main body 27. Cavity 30 is suitably size to receive the insert 28 therein in press-fit or frictional engagement, such that insert 28 is securely engaged once forcibly inserted into cavity 30. Insert 30 presents a textured front surface defining a traction striking surface 34 which faces outward from the cavity 30 when insert 28 is secured therein. The striking face 32 of the hammer head main body 27 is relatively smooth (as compared to traction striking surface 34) and surrounds the insert 28 secured within cavity 30. The traction striking surface 34 of the insert or disk 28 includes a plurality of peaks 36 and valleys 37.

The thickness, $T_d$, of the insert or disk 28 (from a rear face 39 of the disk 28 to the peaks 36) is less than the depth, $T_c$, of the cavity 30. When the disk 28 is fully inserted into cavity 30 in bottomed engagement, the traction striking surface 34 is recessed below the relatively smooth, peripheral striking surface 32 by the difference between $T_c$ and $T_d$. An inner chamfer 41 is preferably formed in the hammer head main body 27 around an inner edge of the peripheral striking face 32 and around the cavity 30 to assist in guiding the disk 28 as it is inserted into the cavity 30. Alternatively, a chamfer could be formed around the rear face 39 of disk 28 to facilitate insertion of the disk 28 into cavity 30. An outer chamfer 43 is preferably formed in the hammer head main body around an outer edge of the peripheral striking face 32 in compliance with recognized hammer manufacturing standards.

In the embodiment shown the disk 28 and the cavity 30 are cylindrical. However, it is foreseen that other geometries including disk of square cross-section and a correspondingly shaped cavity could be used. In an exemplary embodiment with a cylindrical disk 28 and cavity 30, the diameter of each is approximately one inch. The peripheral striking face 32 of the hammer head 22 has a width of approximately one quarter of an inch along substantially the entire circumference thereof such that the diameter of the hammer head 22 across the peripheral striking face 32 is approximately one and one half inches. Similar dimensions may apply to an embodiment in which the traction striking surface is integrally formed in the hammer head as in the embodiment shown in FIG. 1.

The disk 28 is preferably hardened relative to the material used for hammer head main body 27 (and/or comprised of a harder material), including that portion of the hammer head main body 27 defining the peripheral striking surface 32. For example, the insert or disk 28 may be formed from hardened steel and the hammer head main body 27 formed from titanium or a titanium alloy or from a softer steel. For example, the disk 28 could have a hardness of approximately 61 on the Rockwell C scale compared to a hardness of approximately 35 for the hammer head main body 27. However, it is to be understood that in some embodiments, the material forming the striking face 5 of the first embodiment or the disk 28 of the second embodiment could be formed from the same material as or of a material with the same hardness as the material forming the rest of the hammer head 2 or 22 or both.

A variety of production methods can be utilized for producing a hammer with a striking surface as in the embodiments described above. With respect to hammer 20 in which the hammer head 22 includes a main hammer head main body 27 and inserted disk 28, the main body 27 and disk 28 are formed separately. The hammer head main body 27 is preferably formed by well known metal casting processes suitable for the material of construction of the hammer head main body 27. The hammer head main body 27 may be cast with or without the cavity 30 formed therein. If the main body 27 is cast without a cavity 30 formed therein, the cavity 30 can be machined or milled into the main body 27. Similarly, a rough cavity may be formed in the casting process and a secondary machining process can then be used to form the cavity 30 to more precise dimensions. However, it is understood that existing metal casting processes are suitable for repeatedly producing hammer head main bodies 27 with precisely dimensioned cavities 30 to securely receive the disks 28 without further machining.

Referring to FIGS. 5 and 6, the knurled disk 28 may be formed by machining two sets of grooves 51 (one set shown in FIG. 5) in a crisscross pattern into the end of a metal rod 55 and then cutting off the end of the rod 55 to the length $T_d$. As discussed above the resulting length, $T_d$, of disk 28 is less than the depth, $T_c$, of cavity 30, by the desired distance the peaks 36 of disk 28 are to be recessed relative to the striking face 32 of hammer head main body 27. The grooves 51 are v-shaped with one set of grooves 51 extending perpendicular to the other set. In addition, the grooves 51 in each set are formed immediately adjacent one another to form the series of pointed peaks 36 and corresponding inwardly pointed valleys 37. The grooves 51 extend across the entire face of one end of the rod 55. Virtually any other pattern is acceptable so long as it presents a roughened texture.

Prior to machining the grooves 51 in the rod 55, the rod 55 is machined to the desired diameter. In a preferred embodiment it is foreseen that the rod 55 and therefore the disk 28 as well as the cavity 30 will each be approximately one inch in diameter. It is to be understood that the rod 55 and disk 28 may be slightly wider in diameter than the cavity 30 in the hammer head main body 27 to ensure a secure friction fit when the disk 28 is pressed into the cavity 30. For example, the disk 28 may have a diameter of approximately 0.982 inches and the cavity a diameter of 0.980 inches.

The disk 28 is positioned in alignment with the cavity 30 (a little grease can optionally be used to facilitate installation of the disk 28 in the cavity 30 and then press-fit into engagement in the recessed cavity 30 of the hammer head main body 27. Precise sizing of the disk 28 and the cavity 30 provides a snug fit that holds the disk 28 in place, even under extreme use. The disk 28 may be driven into the cavity 30 using a separate hammer 61 and a punch rod 62 of relatively soft metal to avoid damaging or smoothing out the knurling on the disk 28. It is foreseen that means other than frictional engagement could be used to hold or retain the disk 28 in the cavity 30, including wedges or set screws.

Alternatively, the disk could be machine pressed in place, or installed by use of a vise or similar compression device. However, from a practical manufacturing perspective, perhaps the most expeditious approach would be "stamping" the piece in with a suitable form of machine press.

Another option would be to forge the hammer head with the cavity already in it, and a similar process being practiced for formation of the disk with the pattern cut into it. Then, the disk could be installed into the cavity in a separate step.

As discussed above, with reference to the embodiment of the hammer 1 shown in FIG. 1, the hammer head 2 could be forged with the waffle pattern cut in and recessed into the face of the striking surface all in one piece, and the hammer head could then have the traction pattern optionally hardened. Or the entire hammer head could be hardened, if so desired.

Figure 8:
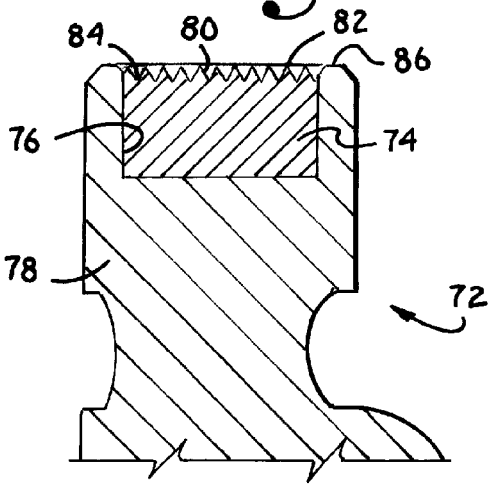
FIG. 8 is a fragmentary cross-sectional view of an alternative embodiment of a hammer head showing a knurled insert inserted into a cavity in the head and presenting a knurled surface with peaks extending flush with a surrounding striking face of the hammer head.

Referring to FIG. 8, there is shown an alternative embodiment of a hammer head 72 having a knurled insert 74 received within a cavity 76 formed in the hammer head main body 78. The knurled insert 74 has an outwardly facing traction surface 80 including peaks 82 and valleys 84. Distal ends of the peaks 82 extend flush with a surrounding striking face 86 of the hammer head 72 which is generally smooth. The traction surface 80 could be machined into the hammer head main body 78. The material forming the traction surface could be formed from a harder material than the material forming the surrounding striking face 86 or treated to be harder. It is also understood that some peaks 82 could extend flush with the surrounding striking face 86 while others are slightly recessed.

It is also noted that the waffle pattern can take the form of virtually any design that would provide a grooved or rough surface for gripping nails. The waffle 20 design mentioned above herein is considered a simple, easy, fastest, and cost effective way of achieving the functional and structural objects of the invention. The cross cut diamond pattern is the fastest and easiest as well as the probably the most effective traction surface. However, literally any pattern imaginable which provides a traction surface is deemed acceptable to practice of the invention that has a raised, grooved or like textured surface. It is noted that all conventional production techniques suitable for production of known hammer heads and like tool parts can be employed to achieve the inventive hammer feature/hammer head.

Furthermore, while the above example uses a disk separate from the main hammer head structure, the invention can also be practiced in a hammer head in which a recess with a textured striking surface is integrally formed in the face of the head. It also is to be understood that the recessed and textured surface of the hammer head could be machined into the face of the hammer head 2. If selective hardening only of the textured recess was then optionally desired, partial spot heat treating techniques could be employed to harden the waffle, while leaving the remaining border substantially unhardened.

It is foreseen that as with other framing hammers, the hammer head 22 could include one or more grooves formed in an outer periphery of the hammer head 22 and perpendicular to the striking surface to receive the shaft of a nail and that one or more magnets could be incorporated into the hammer head to hold a nail in place in a selected one of the grooves to facilitate starting the nail in hard to reach places using the hammer. As appropriate, other features found in existing framing hammers can be incorporated into the hammers disclosed and described herein.

What is claimed is:

1. A hammer head, comprising:

a hammer head main body having a cavity formed therein and surrounded by a peripheral striking face; and an insert having a textured surface, said insert being securely received in said cavity such that said textured surface faces outwardly from said cavity and said textured surface is recessed inward from an outer surface of said peripheral striking face.

2. The hammer head as in claim 1 wherein an outwardly facing end of said textured surface of said insert is recessed relative to said peripheral striking face by approximately one sixteenth of an inch or less.

3. The hammer head as in claim 1 wherein an outwardly facing end of said textured surface of said insert is recessed relative to said peripheral striking face by approximately one eighth of an inch or less.

4. The hammer head as in claim 1 wherein said insert is formed from a material that is harder than said hammer head main body.

5. The hammer head as in claim 4 wherein said hammer head main body is formed from titanium or a titanium alloy.

6. The hammer head as in claim 5 wherein said insert is formed from hardened steel.

7. The hammer head as in claim 1 wherein said peripheral striking face is relatively smooth.

8. The hammer head as in claim 1 wherein said insert is a disk and said peripheral striking face has a width which is approximately one quarter the length of a diameter of said insert.

9. The hammer head as in claim 1 wherein an inwardly sloping chamfer is formed around an outer edge of said cavity.

10. A hammer head, comprising:

a hammer head main body formed from a first material and having a cavity formed therein and surrounded by a peripheral striking face; and an insert having a textured surface, said insert being securely received in said cavity such that said textured surface faces outwardly from said cavity and said textured surface is recessed inward from an outer surface of said peripheral striking face by approximately one eighth of an inch or less; said insert formed from a second material that is harder than said first material forming said hammer head main body.

11. The hammer head as in claim 10 wherein an inwardly sloping chamfer is formed around an outer edge of said cavity.

12. A hammer head, comprising a hammer head main body having an outer striking face and an outwardly facing knurled surface which is recessed relative to said outer striking face, and said outer striking face extends around a periphery of said outwardly facing knurled surface; wherein said portion of said hammer head forming said knurled surface is harder than said outer striking surface of said hammer head.

13. The hammer head as in claim 12 wherein an outwardly facing end of said knurled surface is recessed relative to said outer striking face by approximately one sixteenth of an inch or less.

14. The hammer head as in claim 12 wherein an outwardly facing end of said knurled surface is recessed relative to said outer striking face by approximately one eighth of an inch or less.

15. The hammer head as in claim 12 wherein said outer striking surface is relatively smooth.

16. A hammer head, comprising a hammer head main body having an outer striking face and an outwardly facing knurled surface which is surrounded by said outer striking face, and said outwardly facing knurled surface is harder than said outer striking face of said hammer head.

17. The hammer head as in claim 16 wherein said outwardly facing knurled surface includes a plurality of peaks and valleys wherein distal ends of said peaks do not extend outward beyond said outer striking face.

18. The hammer head as in claim 16 wherein said outwardly facing knurled surface includes a plurality of peaks having distal ends extending generally flush with said outer striking face.

* * * * *